United States Patent [19]

Gast

[11] 4,060,156

[45] Nov. 29, 1977

[54] LIQUOR TRUNK

[76] Inventor: Gary Gast, 515 Janssen St., Combined Locks, Wis. 54113

[21] Appl. No.: 769,504

[22] Filed: Feb. 17, 1977

[51] Int. Cl.[2] ..... A45C 5/12; A45C 13/02

[52] U.S. Cl. ..... 190/30; 190/17; 190/51

[58] Field of Search ..... 190/16, 17, 30, 33, 190/51

[56] References Cited

U.S. PATENT DOCUMENTS

| | | | |
|---|---|---|---|
| 781,857 | 2/1905 | Wigington | 190/30 |
| 804,360 | 11/1905 | Wigington | 190/30 |
| 857,500 | 6/1907 | Turman | 190/30 |
| 993,469 | 5/1911 | Stocker | 190/30 |
| 1,102,257 | 7/1914 | Foote | 190/30 |
| 2,552,170 | 5/1951 | Gusmoring | 190/30 |
| 3,347,346 | 10/1967 | Young | 190/51 |

*Primary Examiner*—Ro E. Hart
*Attorney, Agent, or Firm*—Robert D. Farkas

[57] ABSTRACT

A liquor trunk for storage of glasses and liquor bottles includes a body having a base, a pair of upwardly extending end walls, an upwardly extending front wall, an upwardly extending rear wall, an open top and a chamber therein. A cover member has a top, a pair of downwardly extending end walls, a downwardly extending front wall, a downwardly extending rear wall, an open base, and a chamber therein. A plurality of hinge elements join the cover to the base. A pair of elongated board elements are longitudinally disposed in the chamber of the cover, wherein the upper board element has a plurality of openings therethrough, wherein the glasses are insertable through the openings to rest on the lower board element. A mechanism is included for maintaining the glasses in position. A glass rack is longitudinally disposed in a forward portion of the chamber of the body. A bottle rack is disposed in the chamber of the body rearwardly of the glass rack. A mechanism is included for moving the bottle rack vertically upwardly or downwardly within the chamber of the body as the cover opens and closes.

9 Claims, 4 Drawing Figures

LIQUOR TRUNK

BACKGROUND OF THE INVENTION

A plurality of variously designed liquor cabinets have been employed in a number of U.S. patents, but these devices fail to provide the unique and novel movable storage rack of my present invention. These U.S. Pat Nos. are: D100,124 to Rockola; D125,862 to Kranz; 131,957 to Corbett; D192,568 to Anderson; 222,086 to Guilbeaux; 232,286 to Galuten; 233,717 to Stewart; and 234,413 to Mompeano.

SUMMARY OF THE INVENTION

My present invention relates to an improved liquor trunk for storage of liquor bottles and glasses therein.

An object of my present invention is to provide an improved liquor trunk having a movable bottle rack therein, a novel means for retaining stored glasses in position within the trunk, and an exterior antique surface.

Briefly, my present invention comprises a body having a base, a pair of upwardly extending end walls, an upwardly extending front wall, an upwardly extending rear wall, an open top and a chamber therein. A cover member has a top, a pair of downwardly extending end walls, a downwardly extending front wall, a downwardly extending rear wall, an open base, and a chamber therein. A plurality of hinge elements join the cover to the base. A pair of elongated board elements are longitudinally disposed in the chamber of the cover, wherein the upper board element has a plurality of openings therethrough, wherein the glasses are insertable through the openings to rest on the lower board element. A mechanism is provided for maintaining the glasses in position. A glass rack is longitudinally aligned in a forward portion of the chamber of the body. A bottle rack is disposed in the chamber of the body rearwardly of the glass rack. A mechanism is provided for moving the bottle rack vertically upwardly or downwardly within the chamber of the body as the cover opens and closes.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 2:
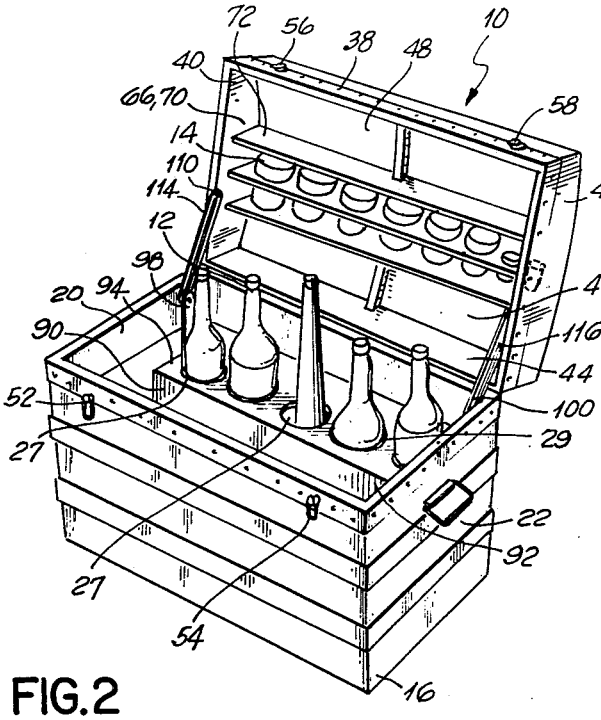
FIG. 2 illustrates a perspective view of the liquor trunk, when it is closed.
Figure 1:
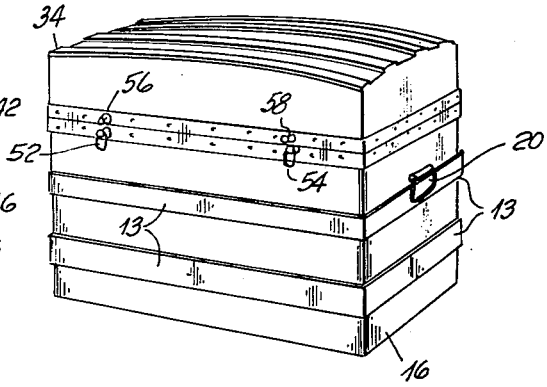
FIG. 1 illustrates a perspective view of a liquor trunk which is opened.
Figure 3:
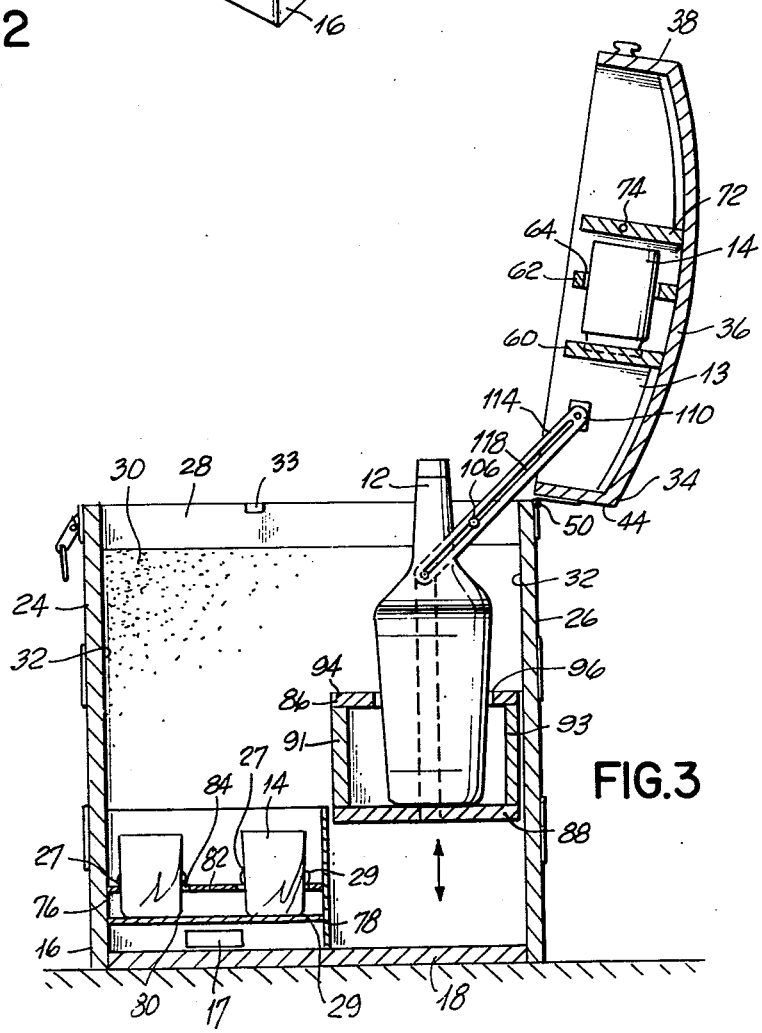
FIG. 3 illustrates an end cross-sectional view of the trunk.
Figure 4:
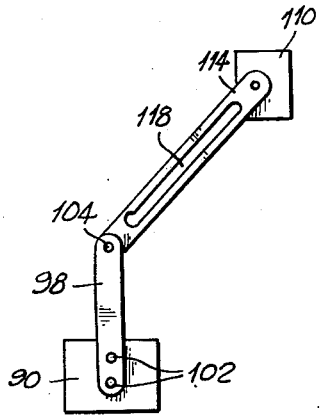
FIG. 4 illustrates a side view of a hinge assembly of the trunk.

Turning now descriptively to the drawings, in which similar reference characters denote similar elements throughout the several views, FIGS. 1–4 show a liquor trunk 10 adapted to removably store bottles 12 of liquor and glasses 14 therein, wherein the trunk 10 is exteriorly designed as a piece of antique furniture. The trunk 10 generally comprises a body 16 having a base 18, a pair of upwardly extending end walls 20, 22, an upwardly extending front wall 24, an upwardly extending rear wall 26, an open top 28, and a chamber 30 therein, wherein the interior surface of walls 20, 22, 24, 26 and the upper surface of base 18 have a cloth-like layer 32 adhered therein by adhesive means such as felt, carpet, or silk. A cover member 34 includes a curved top 36, a downwardly extending front wall 38, a pair of downwardly extending end walls 40, 42, a downwardly extending rear wall 44, a chamber 46 therein and an open base 48. A plurality of hinge elements 50 of an ornamental brass design join the lower end of wall 44 hingeably to the upper end of wall 26. A pair of buckle lock elements 52, 54 are mounted on the upper outer surface of front wall 24 and a pair of lock catch elements 56, 58 are mounted on the lower outer surface of wall 38, wherein elements 52, 54 are removably engaged onto elements 56, 58, when cover member 34 is closed on body 16.

A pair of elongated rectangularly shaped board elements 60, 62 are longitudinally aligned in chamber 46, wherein the ends of elements 60, 62 are affixed to the inner surfaces of end walls 40, 42. The upper board element 62 has a plurality of openings 64 therethrough, wherein the glasses 14 are inserted through openings 64 to rest on the upper surface of the lower board element 60. One of two guide channel bars 66, 68 are mounted on the inner surfaces of each end wall 40, 42 above board element 62, wherein a deformable male snap element 70 is disposed in each channel bar 66, 68. An elongated rectangularly shaped board member 72 has a female snap element 74 disposed in each end such that the ends of member 72 are slideably received into the channel bars 66, 68 as elements 70 engage into elements 74. The lower surface of member 72 engages the upper ends of the glasses 14 thereby maintaining the glasses 14 in position. A glass rack 76 is disposed in a forward portion of chamber 30, wherein rack 76 includes an upwardly extending vertical wall 78 affixed to the upper surface of base 18 and extending longitudinally between the end walls 20, 22, wherein wall 78 extends only partially upwardly into chamber 30. A first horizontally aligned board member 80 extends between end walls 20, 22 and the inner surface of front wall 24 and the center forward surface of wall 78. A second horizontally aligned board member 82 is affixed to the upper edge of wall 78, the inner surface of wall 24 and end walls 20, 22, wherein the member 82 has a plurality of openings 84 therethrough such that glasses 14 insert downwardly through openings 84 to rest on the upper surface of member 80. A bottle rack 86 movably disposed in a rear of chamber 30 includes a base 88, a pair of upwardly extending end walls 90, 92, a front 91 and a rear 93 wall, and a top 94 with a plurality of openings 96 therethrough wherein liquor bottles 12 insert downwardly through openings 96 to rest on base 88. One of a pair of elongated bar members 98, 100 is mounted by a pair of screw means 102 onto each end wall 90, 92, wherein each bar member 98, 100 extends vertically upwardly from the top 94. A pin element 104 is affixed onto the inner surface of each bar member 98, 100 at an upper end thereof. One of a pair of pin members 106 are mounted on the inner upper surfaces of end walls 20, 22. One of a pair of bracket members 110 are mounted on the inner surfaces of end walls 40, 42.

An upper end of one of two elongated bar elements 114, 116 is pivotally mounted to each of the bracket members 110, 112, wherein each bar element has an elongated slotted, longitudinally aligned groove 118 therethrough, wherein the lower end of each groove 118 is hook shaped. The pin element 104 of each bar member 98, 100 is pivotally mounted through the lower end of each bar element 114, 116. One of the pin members 106, is slidably disposed in each of the grooves 118. As the cover is raised bar members 98, 100 are pulled vertically upwardly causing the rack 86 to move upwardly in chamber 30. The cloth-like layer 32 is deposited also on the inner surfaces of cover member 34. A handle member 120 is affixed onto the exterior surface of each end wall 20, 22. The outer surface of body 16 and cover member 34 is finished in metal with horizontally aligned lathes of wood 13 to impart an antique finish. A pushbutton electrical switch member 33 is disposed in the upper edge of wall 24, wherein switch member 33 is open, when the cover 34 is closed upon the body. A light means 15 is disposed in the chamber of cover 34 and a battery means 17 is disposed in chamber 30, wherein battery means 17, switch member 33 and light means 15 are wired in series whereby light means 15 illuminates the trunk 10 in the dark.

A plurality of pairs of spring clips 27, 29 are disposed on the upper surfaces of board member 82 and top 94 around openings 84, 96, wherein spring clips 27, 29 frictionally engage onto the sidewalls of the glasses 14 and bottles 12 thereby maintaining them in position.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A liquor trunk for storage of glasses and liquor bottles, which comprises:

a. a body having a base, a pair of upwardly extending end walls, an upwardly extending front wall, an upwardly extending rear wall, an open top, and a chamber therein;

b. a cover member having a top; a pair of downwardly extending end walls, a downwardly extending rear wall, a downwardly extending front wall, an open base, and a chamber therein;

c. a plurality of hinge elements hingeably joining said rear wall of said body to said rear wall of said cover member;

d. a first elongated board element longitudinally disposed in said chamber of said cover member;

e. a second elongated board element longitudinally disposed in said chamber of said cover member above said first board element, said second board element having a plurality of openings therethrough, said glasses received through said opening to rest on said board element;

f. a pair of channel guide bars, one of said guide bars disposed on an inner surface of each said end wall of said cover above said second board element;

g. a deformable male snap element disposed in each of said guide bars;

h. an elongated board member, the ends of said board member slideably disposed in said guide bars;

i. a female snap element disposed in each said end of said board member, each said male snap element removably received into one of said female snap elements, said board member engaging against said glasses thereby maintaining said glasses in position;

j. a glass rack longitudinally aligned in a forward portion of said chamber of said body;

k. a bottle rack longitudinally aligned in said chamber rearwardly of said glass rack; and l. means for vertically moving said bottle rack up and down within said chamber of said body, said vertically moving means dependent upon opening and closing of said cover member.

2. A trunk according to claim 1, wherein said bottle rack further includes a base, a pair of upwardly extending end walls, an a top with a plurality of openings therethrough.

3. A trunk according to claim 2, wherein said moving means further includes:

a. a pair of elongated bar members, a lower end of each said bar member affixed onto one of said end walls of said bottle rack and extending upwardly therefrom;

b. a pair of bracket members, each of said bracket members mounted onto an interior surface of one of said end walls of said cover;

c. a pair of elongated bar elements, an upper end of each said bar element pivotally mounted to one of said bracket members, a lower end of each said elongated bar element pivotally joined to an upper end of one of said bar members, each said bar element having a longitudinally aligned groove therethrough; and d. a pair of pin members, each said pin member mounted on an upper inside surface of one of said end walls of said body, one said pin member slideably disposed in said groove of one said bar element, said other pin element slideably disposed in said groove of said other bar element.

4. A trunk according to claim 1 having a lock means for locking said cover closed upon said body.

5. A trunk according to claim 1, further including a cloth like material adhesive secured onto inner surfaces of said body and said cover member.

6. A trunk according to claim 1, wherein the outer surfaces of said body and said cover is metal.

7. A trunk according to claim 6, further including wooden lathes horizontally disposed on said outer surfaces of said body and said cover.

8. A trunk according to claim 1, further including a pair of handle members disposed on said body.

9. A trunk according to claim 1, further including:

A. An electrical pushbuttn on/off switch disposed in an upper edge of said body, said switch member being open with said cover closed upon said body;

b. a battery means disposed in said chamber of said body; and c. a light means disposed in said chamber of said cover, said light means, said electrical switch, and said battery means being wired in a series circuit.

* * * * *